US005715881A

United States Patent [19]

Ruskamp et al.

[11] Patent Number: 5,715,881

[45] Date of Patent: Feb. 10, 1998

[54] TEMPORARY TRAFFIC SIGNAL LIGHT COVER

[76] Inventors: Loren D. Ruskamp, 13000 SW. 14th St., Roca, Nebr. 68430; Roger G. Olson, 3930 N. 13th St., Lincoln, Nebr. 68521

[21] Appl. No.: 494,777

[22] Filed: Jun. 26, 1995

[51] Int. Cl.[6] ..... B65D 65/10; B65D 65/16

[52] U.S. Cl. ..... 150/154

[58] Field of Search ..... 150/154, 168; 296/95.1; 160/354, DIG. 2, DIG. 3; 390/928

[56] References Cited

U.S. PATENT DOCUMENTS

| | | | |
|---|---|---|---|
| 2,173,338 | 9/1939 | Morris | 160/354 X |
| 2,223,145 | 11/1940 | Wise | 160/DIG. 3 X |
| 2,665,754 | 1/1954 | Claussen et al. | 160/354 |
| 2,717,036 | 9/1955 | Harris | 160/DIG. 2 X |
| 4,139,233 | 2/1979 | Bott | 160/DIG. 2 X |
| 4,597,608 | 7/1986 | Duffy | 296/95.1 |
| 4,726,406 | 2/1988 | Weatherspoon | 296/95.1 X |
| 4,779,918 | 10/1988 | McNamee | 296/95.1 |
| 4,964,667 | 10/1990 | Reis et al. | 296/95.1 |
| 5,121,957 | 6/1992 | O'Shea | 296/95.1 X |
| 5,292,167 | 3/1994 | Hellman | 150/168 X |

FOREIGN PATENT DOCUMENTS

| | | | |
|---|---|---|---|
| 2235233 | 2/1991 | United Kingdom | 160/DIG. 2 |

*Primary Examiner*—Sue A. Weaver

*Attorney, Agent, or Firm*—Zarley,McKee,Thomte, Voorhees & Sease; Mark D. Frederiksen

[57] ABSTRACT

A temporary cover for a traffic signal light includes a sheet of mesh material having an attachment belt extending from one side edge of the mesh and removably connected to the opposite side edge of the mesh. An elastic portion generally centered in the attachment belt is utilized to bias the mesh in position over a traffic signal light. A hook and loop fastener is preferably positioned at each end of the belt and on the mesh to permit ease of detachment and reconnection of the belt to the mesh material. A ring attached to one end of the belt permits removal of the belt and mesh material from the ground.

11 Claims, 2 Drawing Sheets

TEMPORARY TRAFFIC SIGNAL LIGHT COVER

TECHNICAL FIELD

The present invention relates to covers for traffic signal lights, and more particularly to an improved cover which is easily removed yet remains securely in place until it is desired to remove the cover.

BACKGROUND OF THE INVENTION

While traffic signal lights are a necessity of life at many street intersections, they are useless if inoperable, and can be dangerous if malfunctioning. Currently, federal law requires that a traffic signal light which is not in operable condition be covered, to prevent motorists from seeing the lights. The most common method for covering lights has been the use of a burlap bag tied around the signal light.

However, a burlap bag as a temporary signal light cover suffers several problems. First, the weather has a dramatic effect on burlap. Rain will cause the burlap to stretch and sag such that the individual lights of the traffic signal become uncovered, or the bag falls off of the signal light.

The second major problem associated with the use of burlap bags is the cost and time required to install and remove the bags from the signal light. A truck with a lift basket, or similar apparatus is necessary both upon installation of the bag on the light, and then once again to remove the bag from the light once the malfunction in the light has been corrected, or the signal light has been placed in an operable condition.

SUMMARY OF THE INVENTION

It is therefore a general object of the present invention to provide an improved temporary traffic signal light cover.

Another object is to provide a signal light cover which will not break down from exposure to the weather.

Yet another object is to provide a temporary signal light cover which prevents motorists from viewing the signal lights when inoperative, but permits a technician to view the operation of the lights for testing.

Still another object is to provide a temporary signal light cover which may be removed from the ground.

These and other objects will be apparent to those skilled in the art.

The temporary cover for a traffic signal light of the present invention includes a sheet of mesh material having an attachment belt extending from one side edge of the mesh and removably connected to the opposite side edge of the mesh. An elastic portion generally centered in the attachment belt is utilized to bias the mesh in position over a traffic signal light. A hook and loop fastener is preferably positioned at each end of the belt and on the mesh to permit ease of detachment and reconnection of the belt to the mesh material. A ring attached to one end of the belt permits removal of the belt and mesh material from the ground.

DESCRIPTION OF THE PREFERRED EMBODIMENT

Figure 1:
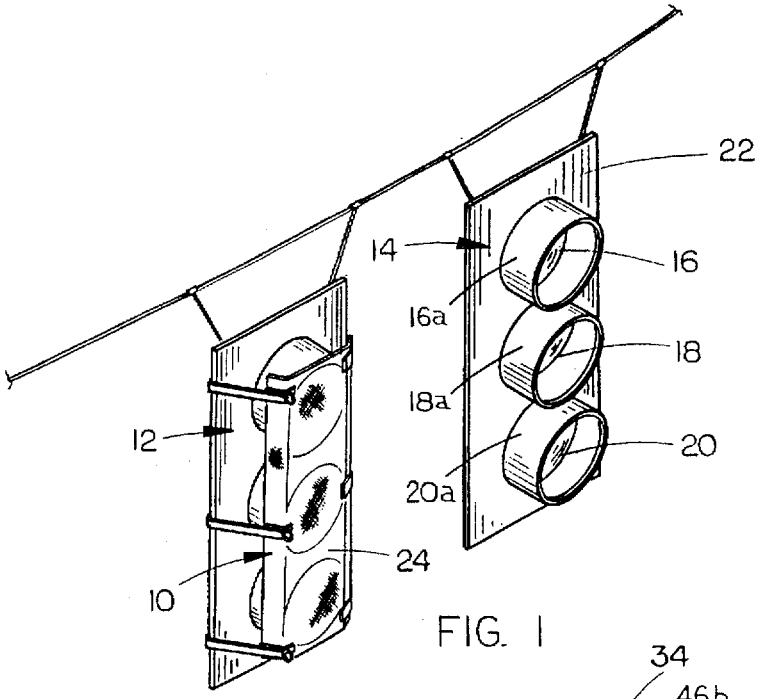
FIG. 1 is a perspective view of two signal lights, one signal light having the cover of the present invention installed thereon.

Referring now to the drawings, in which similar or corresponding parts are identified with the same reference numeral and more particularly to FIG. 1, the temporary traffic signal light cover of the present invention is designated generally at 10 and is shown installed on a signal light 12. A second signal light 14 shows a conventional configuration having three lamps 16, 18 and 20 installed in a forward face 22 of the signal light 14, each lamp having a projecting visor 16*a*, 18*a* and 20*a* respectively.

Figure 2:
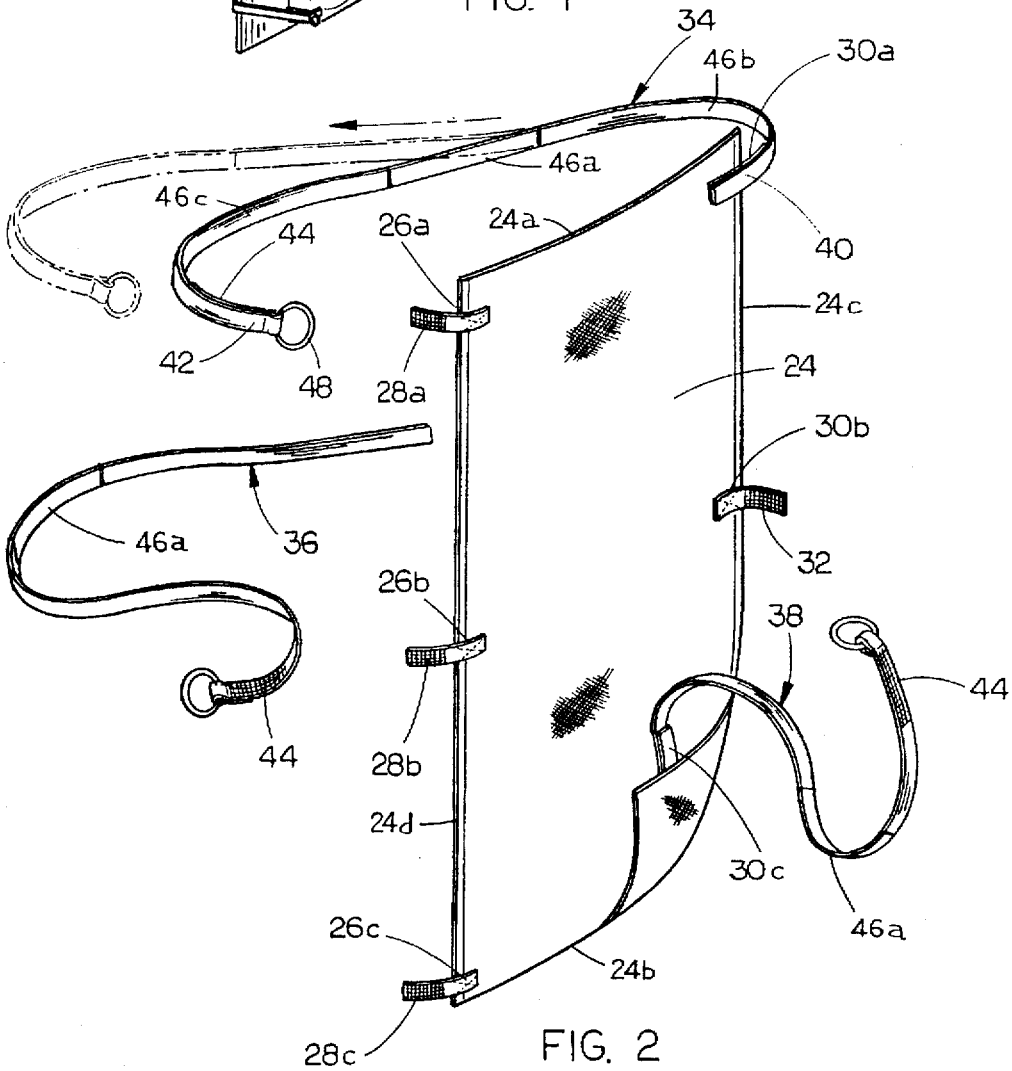
FIG. 2 is an enlarged perspective view of the temporary traffic signal light cover of the present invention.

Referring now to FIG. 2, cover 10 is formed of a mesh material 24 having a generally rectangular shape, with upper and lower edges 24*a* and 24*b*, and opposing vertical side edges 24*c* and 24*d*. Mesh material 24 may be of a sunscreen-type material, and is preferably approximately an 75% screen. In other words, mesh material 24 will block 75% of light passing therethrough.

Three attachment straps 26*a*, 26*b* and 26*c* are spaced along side edge 24*d* of mesh 24. Attachment straps 26*a*, 26*b*, and 26*c* each have a strip of loop material 28*a*, 28*b* and 28*c* respectively on a forward face thereof, which form one-half of a hook and loop fastener as described in more detail hereinbelow.

A second set of attachment straps 30*a*, 30*b* and 30*c* are attached along the opposing side edge 24*c* opposite straps 26*a*, 26*b*, and 26*c*. The second set of straps 30*a*, 30*b*, and 30*c* also have loop material attached to their forward face (as shown on strap 30*b*) which form one-half of a hook and loop fastener.

Three belts 34, 36 and 38 are provided which attach to attachment strap pairs 26*a* and 30*a*, 26*b* and 30*b*, and 26*c* and 30*c*, respectively. Belts 34, 36 and 38 are identical, so only belt 34 will be described in detail herein. Belt 34 includes opposing ends 40 and 42 and inner and outer surfaces respectively. The inner surface of each end 40 and 42 includes a strip of hook material 44 thereon for releasable attachment to the loop material on straps 26*a* and 30*a*, in a conventional fashion. Preferably, belt 34 includes a shod longitudinally elastic portion 46*a* interposed between generally inelastic end portions 46*b* and 46*c*. The length of elastic portion 46*a* is preferably less than the width of the signal light back portion upon which the cover 10 will be affixed. In general, elastic portion 46*a* is less than one-fourth the overall length of belt 34.

Figure 3:
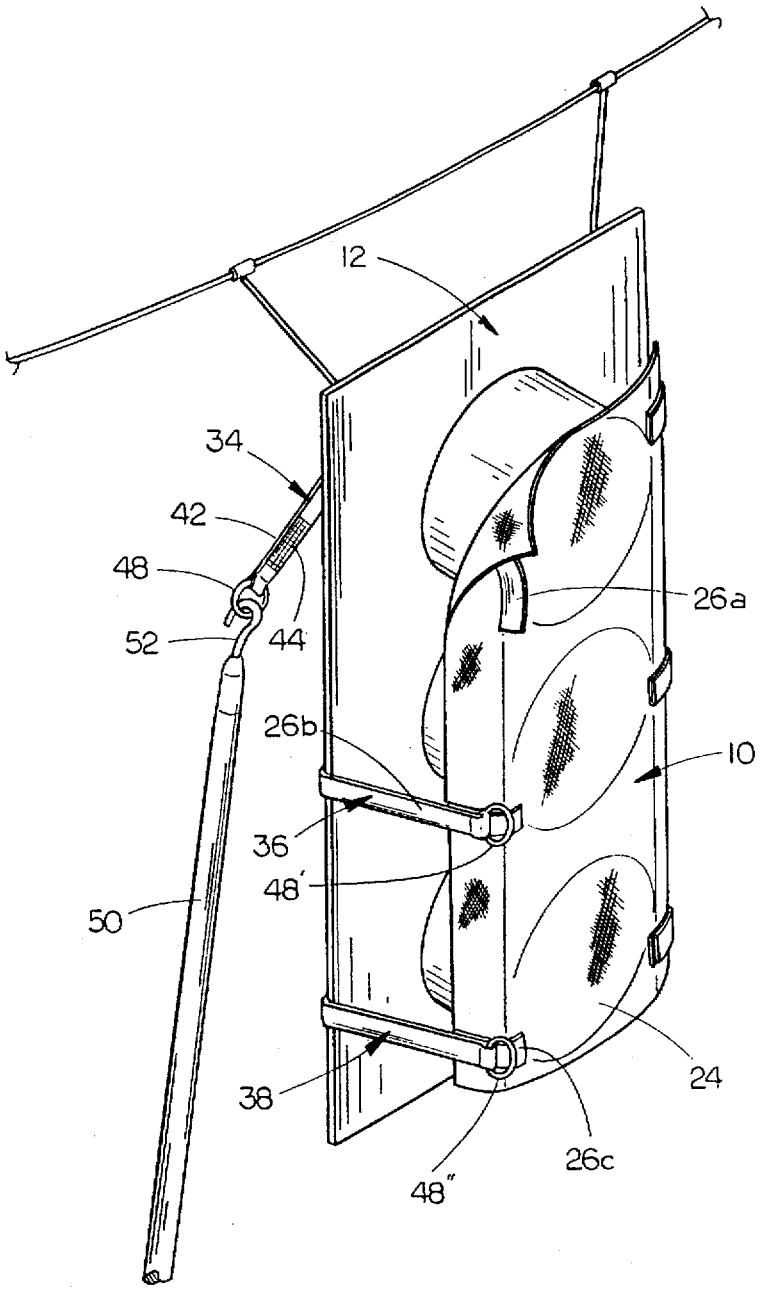
FIG. 3 is an enlarged perspective view of the signal light cover of the present invention in the process of being removed from a signal light.

Referring now to FIG. 3, temporary signal light cover 10 is shown attached to signal light 12, with belts 36 and 38. The upper belt 34 is shown being disconnected from signal light 12, by use of an elongated pole 50, as described in more detail hereinbelow. Belt 34 has a ring 48 affixed to its second end 42, which may be selectively engaged by a hook 52 on pole 50 to permit disconnection of hook material 44 from the loop material on attachment strap 26*a*. Similar rings 48' and 48" are attached to the ends of belts 36 and 38 so that they may also be quickly and easily disconnected from their associated attachment straps 26*b* and 26*c* using pole 50. In this way, signal light cover 10 may be removed from signal light 12 while the operator is standing on the ground, utilizing pole 50.

Because the mesh material 24 permits air to pass therethrough, wind will not blow the cover off of the signal light 12. In addition, the materials of cover 10 will not degrade in rain or adverse weather conditions. The elastic portions 46*a* of each belt 34, 36 and 38 permit some adjustment and stretching to occur when the wind blows, yet secures the cover over the lamps of the signal light. As shown in FIG. 3, cover 10 preferably extends slightly beyond the diameters of the lamp visors 16*a*, 18*a* and 20*a*.

Whereas the invention has been shown and described in connection with the preferred embodiment thereof, many modifications, substitutions and additions may be made which are within the intended broad scope of the appended claims.

We claim:

1. A temporary cover for removable attachment to a traffic signal light of the type having a housing with a plurality of lamps in a forward face, comprising:

a sheet of mesh material having upper and lower edges, opposing side edges, and forward and rearward surfaces and dimensioned to extend across a forward face of the signal light to cover said lamps;

said mesh material having openings therethrough of sufficient size to permit airflow but of a size to substantially prevent the passage of light from the lamps; and a first belt having opposing first and second ends, said first end connected to one of said side edges of said mesh material and the second end having means for removably connecting the second end to the opposing side edge, said belt having a length to extend around the signal light and removably secure the sheet in position on the housing.

2. The cover of claim 1, wherein said belt includes an elastic portion intermediate the ends thereof, said ends being formed of generally inelastic material.

3. The cover of claim 2, wherein each said inelastic end portion has a length greater than the length of the elastic portion.

4. The cover of claim 2, wherein said elastic portion is centered between said ends.

5. The cover of claim 3, wherein said elastic portion is centered between said ends.

6. The cover of claim 2, wherein the length of the elastic portion is less than one-fourth the overall length of the belt.

7. The cover of claim 1, further comprising a second belt having opposing first and second ends, said first end connected to one of said side edges of said mesh material and the second end having means for removably connecting the second end to the opposing side edge, said second belt mounted generally parallel to the first belt and having a length to extend around the signal light housing and secure the sheet in position.

8. The cover of claim 1 wherein said means for removably connecting the belt second end to the sheet includes a first half of a cooperable fastener mounted on the second end of said belt, and a second half of the fastener mounted on said sheet opposing side edge.

9. The cover of claim 8, further comprising a first attachment strap mounted on the forward face of the sheet along the opposing side edge, and wherein said second half of said fastener is mounted thereon for cooperation with the belt fastener first half.

10. The cover of claim 8, further comprising a ring attached to the second end of the belt adjacent the first half of said fastener, for selective engagement with a disconnecting apparatus to selectively disconnect the belt second end from the sheet edge.

11. The cover of claim 1 wherein said mesh material is approximately 75% mesh with 25% openings.

* * * * *